United States Patent [19]

Verhoeven et al.

[11] Patent Number: 4,657,464

[45] Date of Patent: Apr. 14, 1987

[54] PROCESS AND APPARATUS FOR STACKING SPENT ANODES

[75] Inventors: Constant T. Verhoeven, Poederlee; Carolus M-Th. L. Hens, Olen, both of Belgium

[73] Assignee: Metallurgie Hoboken-Overpelt, Hoboken, Belgium

[21] Appl. No.: 720,188

[22] Filed: Apr. 5, 1985

[30] Foreign Application Priority Data

Apr. 17, 1984 [LU] Luxembourg ..... 85321

[51] Int. Cl.[4] ..... B65G 57/081

[52] U.S. Cl. ..... 414/31; 198/466.1; 198/681; 414/55; 414/82; 414/786

[58] Field of Search ..... 414/31, 55, 69, 82, 414/84, 786; 198/466.1, 681

[56] References Cited

U.S. PATENT DOCUMENTS

| | | | |
|---|---|---|---|
| 2,944,655 | 7/1960 | Griswold | 414/45 X |
| 3,770,144 | 11/1973 | Di Frank et al. | 414/55 X |
| 3,823,835 | 7/1974 | Gött et al. | 414/55 |
| 4,020,944 | 5/1977 | Kojima et al. | 198/681 X |
| 4,268,200 | 5/1981 | Fabrig | 414/31 |
| 4,395,175 | 7/1983 | Tsurimoto et al. | 414/55 X |

FOREIGN PATENT DOCUMENTS

| | | |
|---|---|---|
| WO83/02289 | 7/1983 | PCT Int'l Appl. . |
| 1131192 | 10/1968 | United Kingdom . |
| 1449545 | 9/1976 | United Kingdom . |
| 1523983 | 9/1978 | United Kingdom . |

*Primary Examiner*—Leslie J. Paperner
*Attorney, Agent, or Firm*—Fred Philpitt

[57] ABSTRACT

The spent anodes to be stacked are vertically suspended by their lugs to hooks.

The anodes are lifted from the hooks and then rotated alternately 90° and −90° around a horizontal axis; the rotated anodes are lowered to a lower position wherein they are released; the released anodes form a pile on a support positioned under said lower position; and the support is lowered in such a way that the top of the anode pile being formed on it remains under said lower position.

9 Claims, 10 Drawing Figures

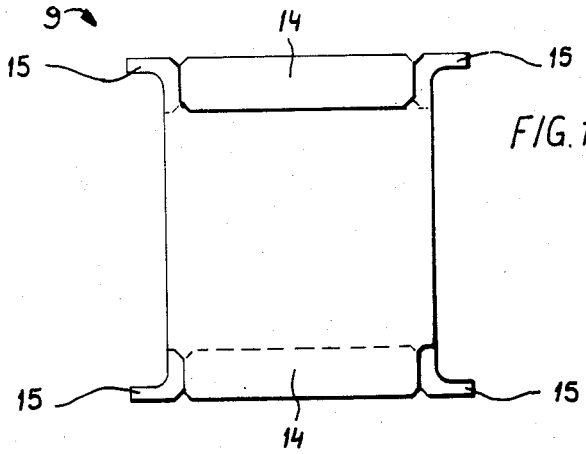
FIG. 10
FIG. 9.
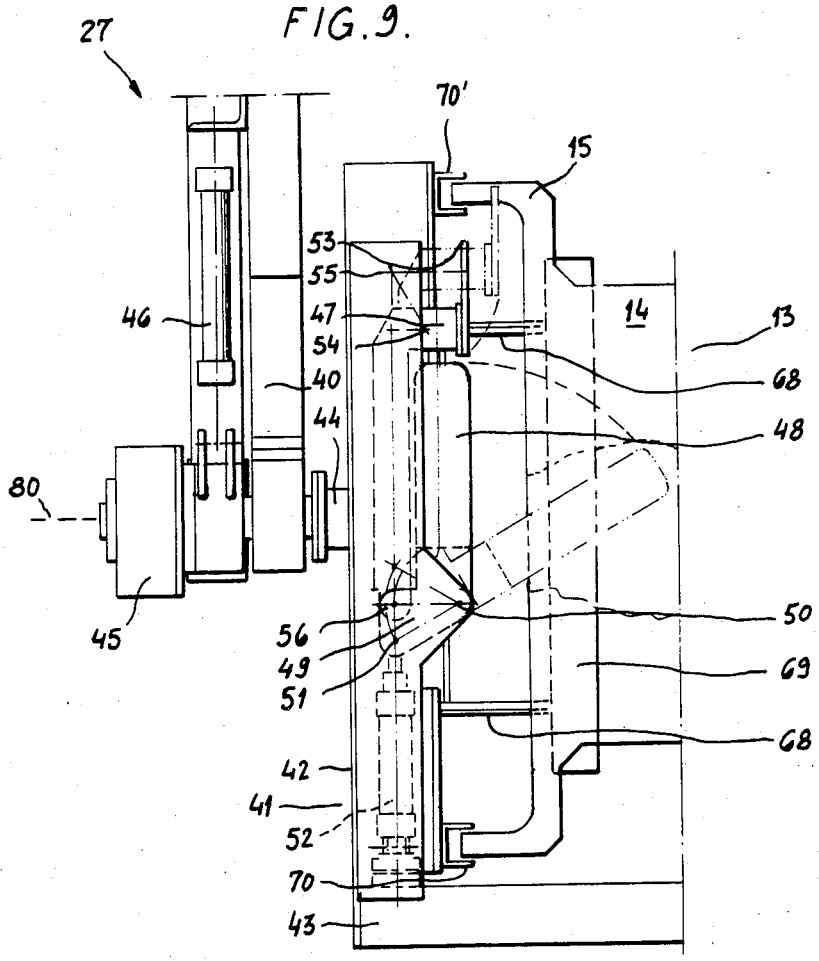

PROCESS AND APPARATUS FOR STACKING SPENT ANODES

The present invention relates to a process for stacking spent anodes, which comprise a spent electrolytic plate and a pair of suspension lugs and which are vertically suspended by their lugs to hooks, according to which process the spent anodes are, one after the other, first lifted from the hooks by their lugs and afterwards brought from their vertical position into a substantially horizontal position.

Such process is described in patent application WO No. 83/02289, more particularly at page 13, last paragraph. In this known process, the anodes, which were brought in a substantially horizontal position, are moved horizontally, the moved anodes are lifted whilst keeping them in a substantially horizontal position, the lifted anodes are alternately rotated 90° and −90° around a vertical axis, the rotated anodes are lifted and then moved, whilst still keeping them in a substantially horizontal position, towards a place, where they are stacked on each other. In such a way, a pile is obtained in which the orientation of an anode is the opposite of the orientation of the preceding anode and of the following anode, i.e. a stable pile. It is clear that such pile is much more stable than a pile, in which all anodes have the same orientation, since the spent electrolytic plate of a spent anode is thinner than its suspension lugs. The drawback of this known process is that it requires a large number of stages to form a stable pile and, consequently, a complicated apparatus for its carrying out. Moreover, it requires a large working area for its carrying out.

The aim of the present invention is to provide a process as defined before, that avoids the drawbacks of the known process.

In the process of the invention the anodes, that have been lifted from the hooks, are alternately rotated 90° and −90° around a horizontal axis, which, if the spent anodes were replaced by the new anodes they originate from, would substantially coincide with the horizontal median axis of the new anodes, this latter axis being located in the plane of the new anode and at equal distance from the top of its lugs and from the lower edge of its electrolytic plate, the rotated anodes are lowered to a lower position, the anodes are released in the lower position, under the aforesaid lower position there is provided a support, on which the released anodes form a pile, and the support is lowered in such a way that the top of the anode pile being formed on it remains below the aforesaid lower position.

The present invention deals also with an apparatus for stacking spent anodes, which comprise a spent electrolytic plate and a pair of suspension lugs and which are suspended vertically by their lugs to hooks, said apparatus comprising unhooking and rotating means adapted to lift the spent anodes from the hooks by their lugs, to rotate the lifted anodes so as to bring them from their vertical position in a substantially horizontal position, and to release the rotated anodes.

Such apparatus is described in the aforementioned patent application WO No. 83/02889. This known apparatus comprises, besides the aforesaid unhooking and rotating means, a pair of chain conveyors, a turning table and a stacking device. The unhooking and rotating means lay the anodes down on the chain conveyors, by bringing them in the aforesaid substantially horizontal position. The chain conveyors move the laid down anodes to above the turning table. The turning table lifts the anodes and rotates them alternately 90° and −90°. The stacking device lifts the anodes from the turning table, then moves them and puts them down on each other to form a stable pile. An essential component of the unhooking and rotating means is formed by elements for supporting the plate of the anode whilst this latter is brought to the substantially horizontal position. The supporting elements can go from a rest position to a working position and vice versa. These supporting elements have to pass, in working position, between the two chain conveyors at the moment the unhooking and rotation means lay down an anode on these chains and they have to pass again between the chains, in rest position, when the unhooking and rotating means are lifted up in order to unhook the next anode. Since the distance between the two chains is restricted by the size of the anodes, said supporting elements have necessarily a small size and, as a matter of fact, a limited action field. Therefore, this known apparatus is unable to handle anodes, the plate of which is spent to such an extent that its surface is substantially smaller than the surface of the new plate it originates from, since such anodes have no contact areas for the aforesaid supporting elements. Besides, such anodes could not be carried by the chain conveyors. Moreover, this known apparatus presents the drawback of being complicated and encumbering and of requiring an important investment.

The aim of the present invention is to provide an apparatus as defined before, that avoids the drawbacks of the known apparatus.

The apparatus of the invention is characterized in that the unhooking and rotating means are adapted to rotate the lifted anodes alternately 90° and −90° around a horizontal axis, which, if the spent anodes were replaced by the new anodes they originate from, would substantially coincide with the horizontal median axis of the new anodes, this latter axis being located in the plane of the new anode and at equal distance from the top of its lugs and from the lower edge of its electrolytic plate, and it comprises moreover first conveying means adapted to move the unhooking and rotating means vertically between an upper position for unhooking a suspended anode and a lower position for releasing a rotated anode, supporting means located under the aforesaid lower position, and second conveying means adapted to move the supporting means vertically.

Other details and characteristics of the invention will appear from the description, given hereafter as a non-restrictive example and with reference to the enclosed drawings, of a process and apparatus for washing and stacking spent anodes, which comprises an embodiment of the process and apparatus according to the invention.

FIG. 9 represents the stacking itself of a spent anode at the stacking station of FIG. 5.

FIG. 10 represents a plan view of a pile of anodes formed at the stacking station of FIG. 5.

The same reference notations indicate identical elements in the different figures.

Figure 1:
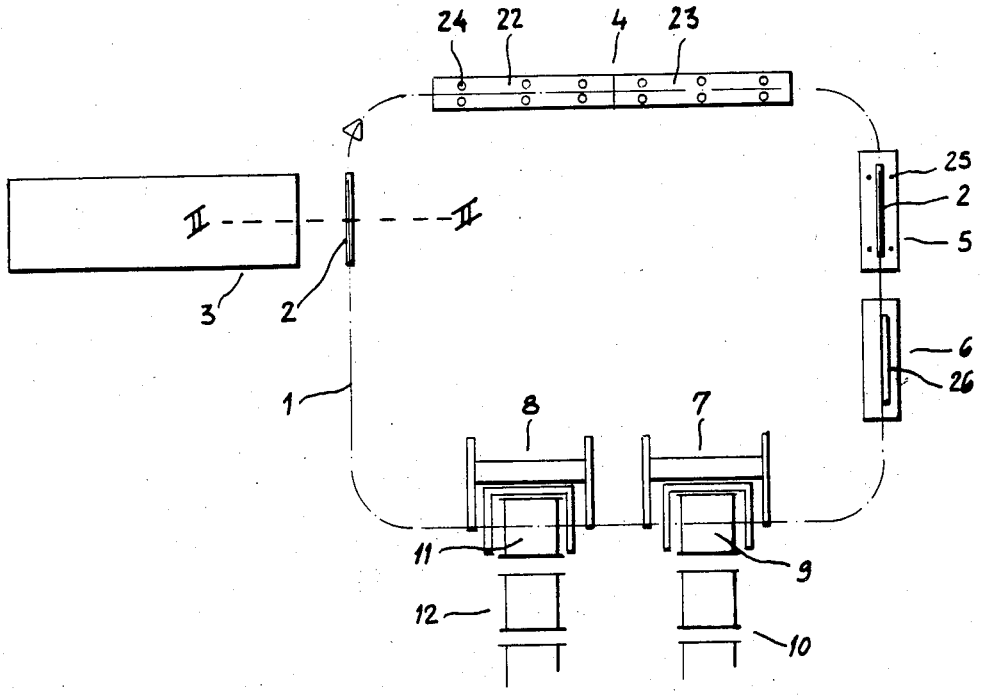
FIG. 1 represents a schematic plan view of an installation for washing and stacking spent anodes, including an apparatus according to the invention for stacking the washed anodes.

The installation represented on FIG. 1 comprises an endless monorail 1 provided with a number of carriages 2 which are individually driven and controlled. Monorail 1 serves successively:

a loading station 3, in which a spent anode is suspended to a carriage 2, a washing station 4, in which the cathodes suspended to carriages 2 are washed by sprinkling, a control station 5, in which the suitability of the anodes to be stacked is controlled, an unloading station 6 for anodes which are not suited to be stacked, a first stacking station 7 for anodes which are suited to be stacked, and a second stacking station 8, which is identical to the first one and which starts operating when the first station has a breakdown.

The anode piles 9 formed at the stacking station 7 are carried off in 10 and piles 11 formed at station 8 in 12.

Figure 3:
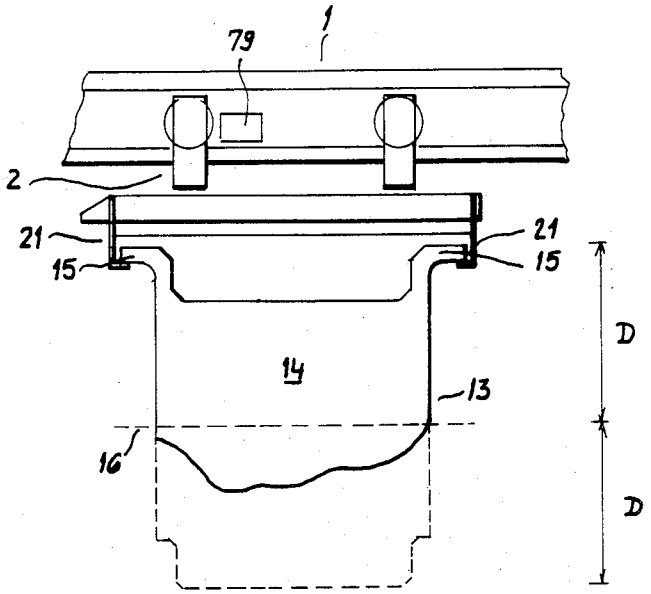
FIG. 3 represents an enlarged elevational frontal view of a device for conveying spent anodes in the installation of FIG. 1.

As shown on FIG. 3, a spent anode 13 consists of a spent metal plate 14 provided with two suspension lugs 15. The upper edge of plate 14 and the suspension lugs 15, which were not dipped in the electrolyte during the electrorefining of the original anode (see dotted lines), the scrap of which is formed by the spent anode 13, are of course much thicker than the remainer of the spent plate 14. Plate 14 of a spent anode may be as large as the plate of the original anode, but it may be smaller too, as shown on FIG. 3, or even much smaller than that one of the original anode. The plates 14 of the spent anodes 13 may thus have very different sizes. In the present patent application one considers as "horizontal median axis" of an original or new anode the axis 16 that is located in the plane of the new anode at an equal distance D from the top of its lugs and from the lower edge of its electrolytic plate (see FIG. 3).

Figure 2:
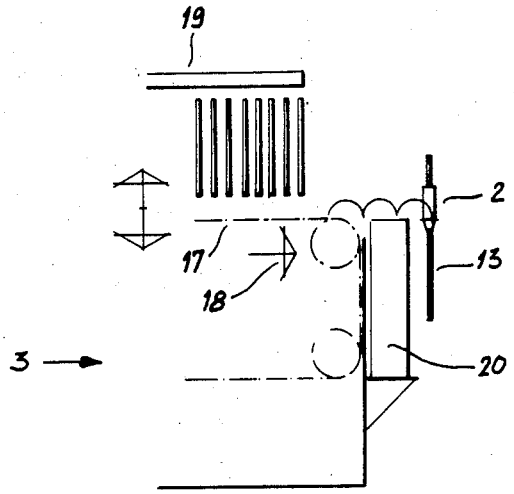
FIG. 2 represents a vertical section through the installation of FIG. 1, made along line II—II of FIG. 1.
Figure 4:
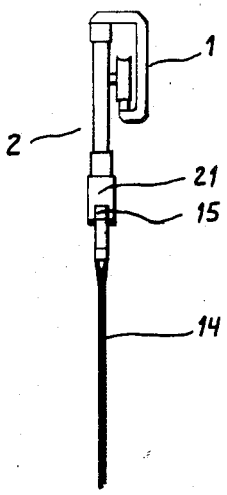
FIG. 4 represents a lateral view of the device of FIG. 3.

Loading station 3, shown on FIG. 2, comprises a pair of conveying chains 17 provided with a not represented motor driving the chains step by step in the direction of arrow 18. Spent anodes 13 to be washed and coming from the tankhouse are deposited in group by means of a rack 19 on the pair of chains 17, which bring the anodes 13 to a walking beam 20. The latter lifts anodes 13 one by one from chains 17 and suspends them on the hooks 21 (see FIGS. 3 and 4) of the carriages 2, which convey them one by one to the washing station 4.

Washing station 4 is similar to the washing station for pairs of cathodes, that is described in the aforesaid patent application WO No. 83/02289 and the mere dedoubling of which is enough to come to the present washing station 4. Consequently, this washing station 4 comprises a washing compartment 22 and a rinsing compartment 23 both provided with sprayers 24.

The control station 5 comprises means 25, for example opto-electronic means, to check whether plate 14 of anode 13 still comprises those parts that are needed for its further handling at the stacking station 7 or 8.

Unloading station 6 comprises means, for example a walking beam 26, to unhook from carriages 2 anodes 3, the plate 14 of which lacks the parts needed for the further handling of the anodes at the stacking station 7 or 8.

Figure 5:
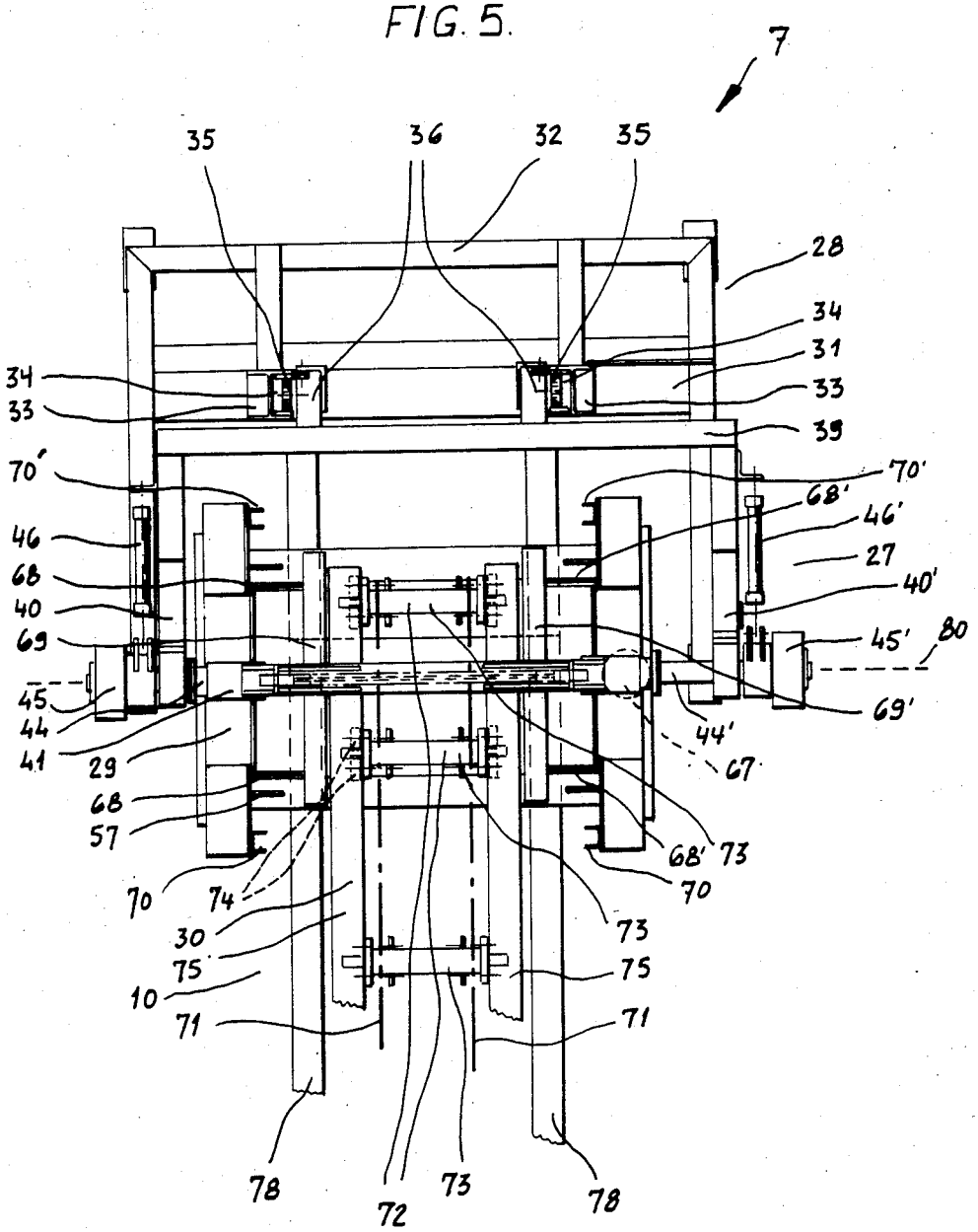
FIG. 5 represents an enlarged plan view of a station of the installation of FIG. 1 for stacking spent anodes brought up by the conveying device of FIGS. 3 and 4.
Figure 6:
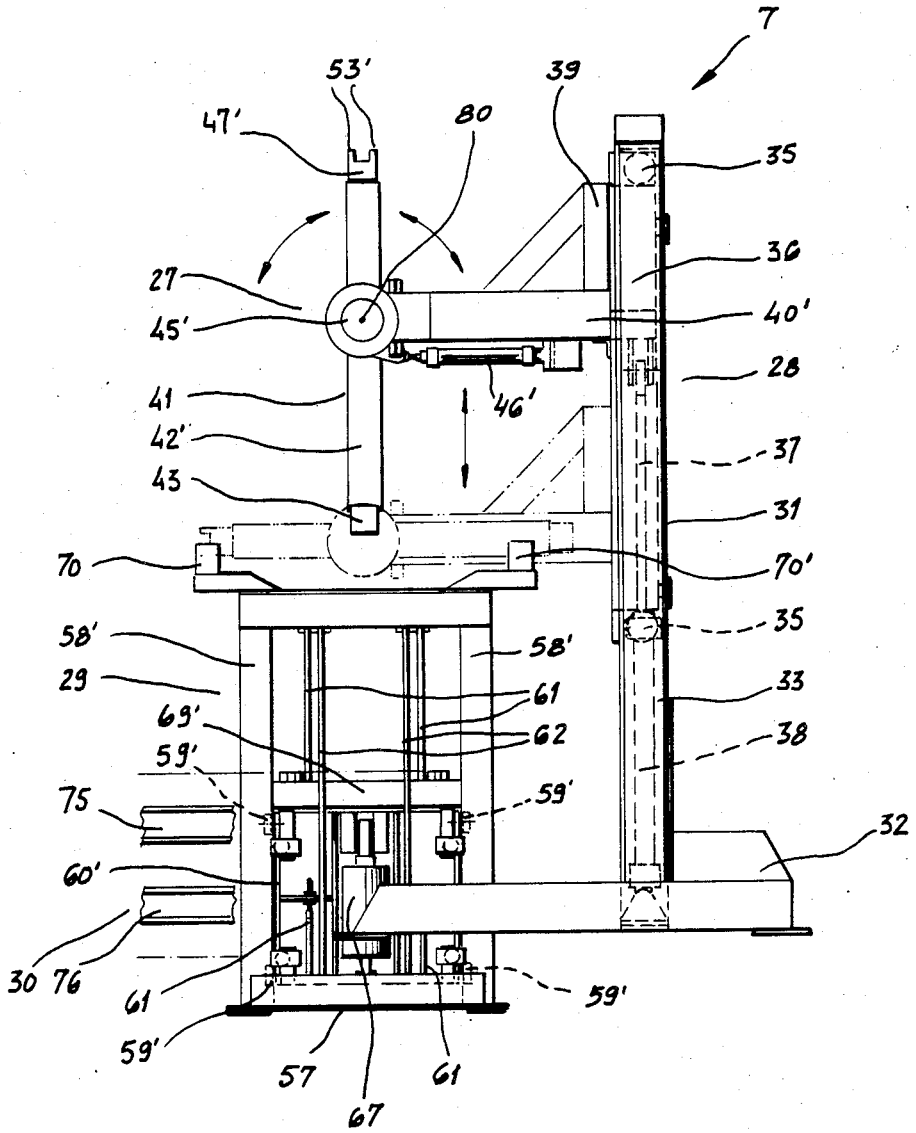
FIG. 6 represents an elevational lateral view of the stacking station of FIG. 5.
Figure 7:
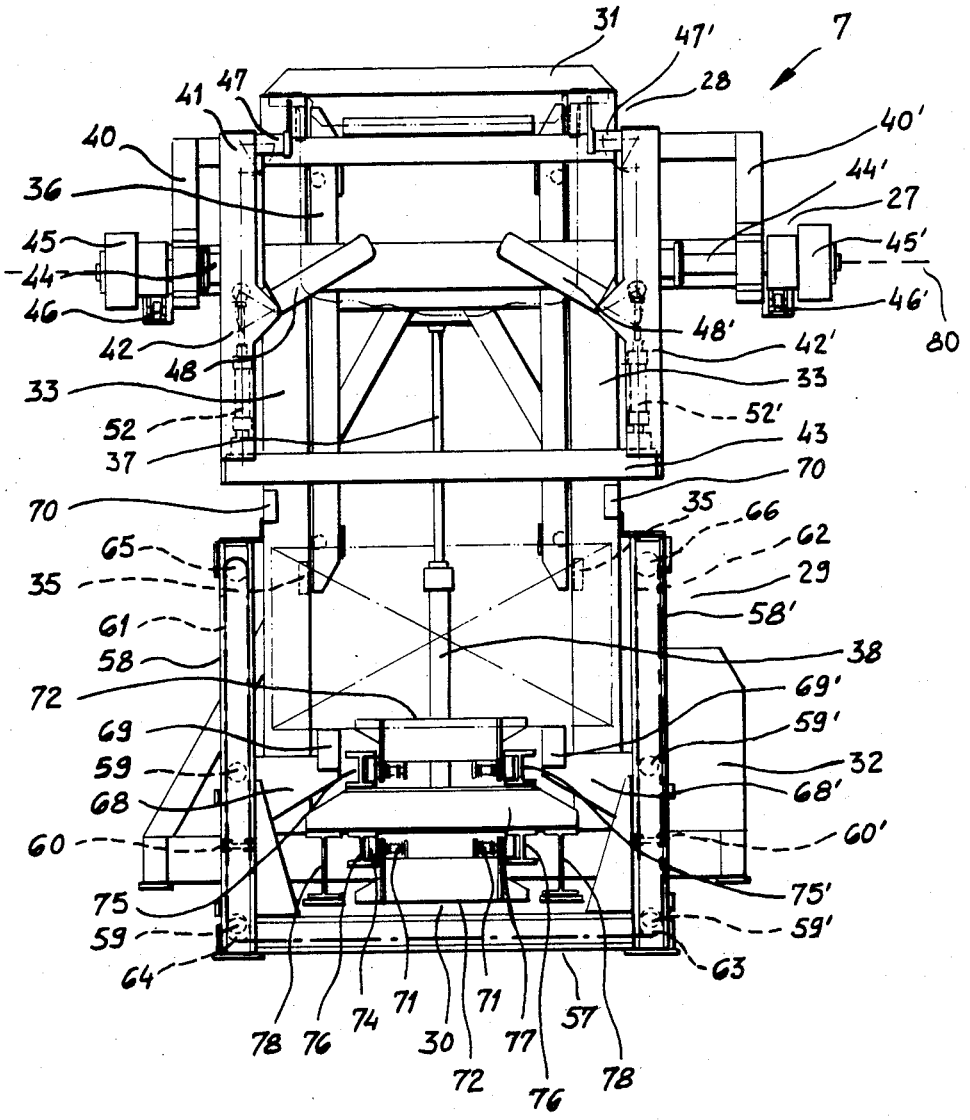
FIG. 7 represents an elevational frontal view of the stacking station of FIG. 5.

As shown on FIGS. 5 to 7, stacking station 7 comprises:

unhooking and rotating means 27 for removing from carriages 2 anodes 13, that were not unhooked at station 6, and for bringing then the anodes 13 in a substantially horizontal position by rotating them alternately 90° and −90°, conveying means 28 for moving the unhooking and rotating means 27 vertically between an upper position for unhooking a suspended anode and a lower position for releasing a rotated anode, stacking means 29 comprising support means, on which anodes 13 released by the unhooking and rotating means 27 in the aforesaid lower position form a pile, and conveying means for moving the supporting means vertically, and evacuating means 30 for evacuating the pile of anodes that was made by stacking means 29.

Conveying means 28 comprise of a frame 31 mounted on a foot 32. Frame 31 comprises two uprights 33 with an I-profile, which form a roller-track 34 for the wheels 35 of a carriage 36. Carriage 36 is driven by the rod 37 of a cylinder 38. The carriage 36 is equipped with a fork 39, the legs 40 and 40′ of which bear the unhooking and rotating means 27.

Unhooking and rotating means 27 comprise a yoke 41 formed by two beams 42 and 42′ with an U-profile and a cross-bar 43. To beam 42 a pivot 44 is fastened that extends through the end of leg 40 of fork 39. Pivot 44 can be coupled with and uncoupled from a coupling device 45, for example an electro-magnetic coupling device. Coupling device 45 is connected with the rod of a cylinder 46. This cylinder 46 is mounted on leg 40 of fork 39. When pivot 44 is uncoupled from coupling device 45, it can turn freely. When pivot 44 is coupled with coupling device 45 and the rod of cylinder 46 is pushed out, pivot 44 rotates 90° clockwise together with yoke 41. When the rod of cylinder 46 is then moved in, pivot 44 rotates, together with yoke 41, 90° in the opposite direction. To beam 42′ a pivot 44′ is fastened, which is in line with pivot 44 and which extends through the end of leg 40′ of fork 39. Pivot 44′ can be coupled with and uncoupled from a coupling device 45′. The coupling device 45′ is connected with the rod of a cylinder 46′. This cylinder 46′ is mounted on leg 40′ of fork 39. When pivot 44′ is uncoupled from coupling device 45′, it can turn freely. When pivot 44′ is coupled with coupling device 45′ and the rod of cylinder 46′ is pushed out, pivot 44′ rotates, together with yoke 41, 90° clockwise. When the rod of cylinder 46′ is then moved in, the pivot rotates, together with yoke 41, 90° in the opposite direction. It is clear that pivot 44′ has to be uncoupled from coupling device 45′, when cylinder 46 is in operation and that pivot 44 has to be uncoupled from coupling device 45 when cylinder 46′ is in operation.

Figure 8:
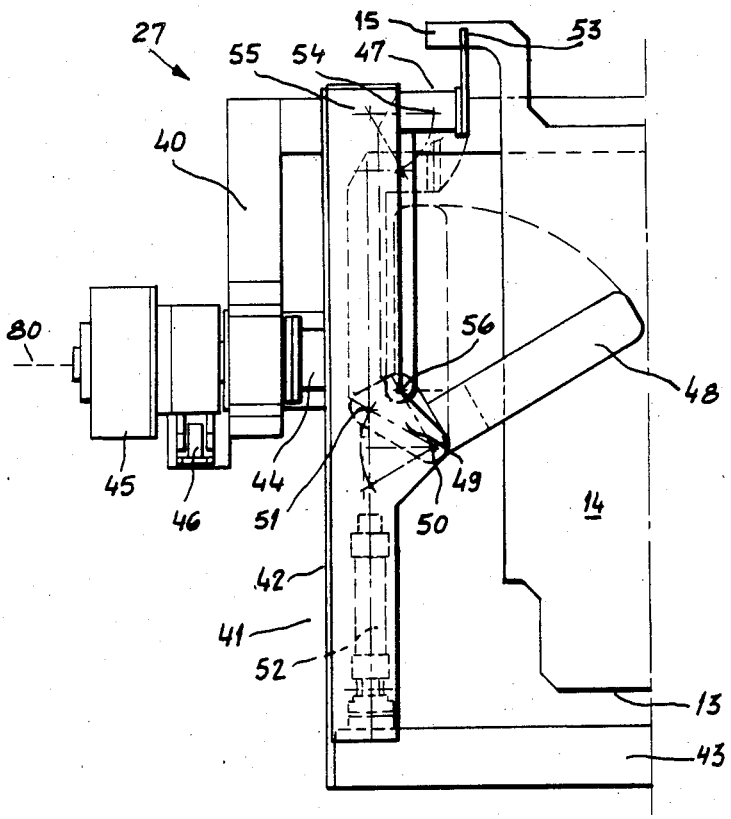
FIG. 8 represents the unhooking of a spent anode from the conveying device of FIG. 3 at the stacking station of FIG. 7.

A mobile hook 47 and a mobile fork 48 are mounted in beam 42 of yoke 41. This hook 47 and this fork 48 can be brought from a rest position, indicated in dotted lines on FIG. 8 and full lines on FIG. 9, into a work position, indicated in full lines on FIG. 8 and in dotted lines on FIG. 9. The back part of fork 48 is rigidly attached to a blade 49, that pivots on a fixed pivot 50 and that is connected in 51 to the rod of a cylinder 52. The upper part of hook 47, that ends in a pair of teeth 53, is connected in 54 by a jointed coupling with a fixed pivot 55, while its lower part is connected by a pivot 56 with blade 49. Hook 47 and fork 48 are in rest position, when the rod of cylinder 52 is moved in (see FIG. 9), and in working position when the rod of cylinder 52 is pushed out (see FIG. 8). Beam 42' of yoke 41 bears also a hook 47', ending in a pair of teeth 53' (see FIG. 6) and a fork 48' as well as the elements needed for their driving, the whole being the reflected image of what has just been described in connection with hook 47 and fork 48. Yoke 41 and its rotating system are designed so that, when a new anode is suspended by its lugs on hooks 47–47' in working position, the axis of rotation 80 of the yoke coincides substantially with the horizontal median axis of the new anode.

Stacking means 29 comprise a frame 57 having two pairs of uprights 58 and 58'. The pair of uprights 58 is provided with a roller-track for the wheels 59 of a carriage 60. The pair of uprights 58' is provided with a roller-track for the wheels 59' of a carriage 60'. Carriage 60 and 60' are connected with each other by a first pair of chains 61 and a second pair of chains 62. Chains 61 go from carriage 60' to carriage 60 by passing around rolls 63, 64 and 65, whilst chains 62 do so by passing around rolls 66, 63 and 64 (see FIGS. 6 and 7). The length of chains 61 and 62 is such that carriages 60 and 60' are at each moment at the same level. Carriage 60' is driven by a telescopic cylinder 67. Thanks to the above-described system of chains and rolls a movement of carriage 60' entails an identical movement of carriage 60. Carriage 60 is provided with two blades 68, to which a supporting element 69 is fastened. Carriage 60' is also provided with two blades 68', to which a supporting element 69' is fastened. The supporting elements 69 and 69' are intended to bear the anodes 13 released by the unhooking and rotating means 27.

At the upper part of frame 57 of stacking means 29 two pairs of guiding elements 70 and 70' with an U-profile are fastened. These guiding elements 70 and 70' have a double aim: preventing the lugs 15 of the anode 13, that is being released by the unhooking and rotating means 27, from making any noticeable horizontal movement and guiding the lugs 15 of the anode 13, that is just released by the unhooking and rotating means, during the fall of the anode.

Evacuating means 30 comprise a pair of endless chains 71 mounted on two pairs of non-represented pinions. One of these pairs of pinions is driven by a non-represented motor. Chains 71 are hollow bearing pin chains with rollers and are commercially available. On chains 71 pairs 72 of supporting elements 73 are mounted, one pair 72 of supporting elements 73 being aimed at receiving a pile of anodes from stacking means 29. Each supporting element 73 is mounted on two successive axes of the chains 71 and is provided on both sides with two wheels 74 for which the two beams 75 form an upper roller-track and the two beams 76 a lower roller-track. The whole weight of the upper run of the pair of chains 71 and its load is thus supported by the beams 75, whilst the whole weight of the lower run of the pair of chains 71 is supported by the beams 76. Beams 75 and 76 are mounted on cross-bars 77, forming together with two longitudinal girders 78 the frame of the evacuation means 30.

The installation of FIG. 1 comprises moreover known but not represented detection devices for detecting the arrival of an empty carriage 2 at the loading station 3 and the arrival of a loaded carriage 2 at the washing compartment 22, at the rinsing compartment 23, at the control station 5, at the unloading station 6, at the first stacking station 7 and at the second stacking station 8. The detection device of the unloading station 6 starts operating only when the control station 5 detected a spent anode that cannot be treated at station 7 or 8. The detection device of the second stacking station 8 starts operating only when the first stacking station 7 has a breakdown. When a carriage 2 is detected by one of these detection devices, its motor 79 (see FIG. 2) stops for a predetermined time T, for instance for 5 seconds.

The installation operates as follows. When an empty carriage 2 is detected at loading station 3, it stops and walking beam 20 starts operating and suspends a spent anode 13 to carriage 2. After a time T, the loaded carriage 2 leaves loading station 3 and goes to washing station 4. When the loaded carriage 2 is detected at washing compartment 22, it stops and sprayers 24 of this compartment start operating. After a time T these sprayers stop operating and carriage 2 passes to rinsing compartment 23. When carriage 2 is detected at rinsing compartment 23, its stops and sprayers 24 of this compartment start operating. After a time T, these sprayers stop operating and carriage 2 passes to control station 5. When carriage 2 is detected at control station 5, it stops and checking means 25 start operating and check whether plate 14 of spent anode 13 suspended to carriage 2 has still those parts that are required to have the plate 14 later on contacted and hence supported by at least one of forks 48 and 48' in working position. If checking means 25 do not detect said parts, i.e. if plate 14 of anode 13 is spent to such an extent that it would not be supported by at least one of forks 48 and 48', if anode 13 would be suspended by its lugs 15 to hooks 47 and 47', and if yoke 41 would be in a position other than vertical, anode 13 shall not be treated at stacking station 7 or 8. In that case, the detection device of unloading station 6 starts operating and carriage 2 leaves control station 7 after a time T. When carriage 2 is then detected at unloading station 6, it stops and walking beam 6 unhooks anode 13 from carriage 2 and drops it in a non-represented basket. After a time T, unloaded carriage 2 leaves unloading station 6 and returns, while passing through stacking stations 7 and 8, to loading station 3.

If checking means 25 detect the said parts, which is normally the case, the loaded carriage 2, which has left control station 5, goes to the first stacking station 7, where it stops. When carriage 2 loaded with an anode 13 reaches stacking station 7:

carriage 36 of conveying means 28 is in its lower position, the rod 37 of cylinder 38 being moved in;

yoke 41 of unhooking and rotating means 27 is in a horizontal position, shown in dotted lines on FIG. 6, with its cross-bar 43 located between the legs 40 and 40' of fork 39, pivot 44 being coupled with coupling device 45, pivot 44' being uncoupled from coupling device 45' and the rods of cylinders 46 and 46' to being moved 17; and hooks 47 and 47′ as well as forks 48 and 48′ are in rest position, the rods of cylinders 52 and 52′ being moved in.

When carriage 2 stops at stacking station 7, rod 37 of cylinder 38 is pushed out and carriage 36 goes with the yoke 41 to its upper position. When carriage 36 is detected in its upper position by a known and not represented detection device, the rod of cylinder 46 is pushed out and yoke 41 rotates 90° clockwise, which brings it in a vertical position, shown in full lines on FIG. 6. When yoke 41 is detected in this vertical position by a known and not represented detection device, the rods of cylinders 52 and 52′ are pushed out, thereby bringing hooks 47–47′ and forks 48–48′ in working position, hooks 47–47′ lifting now anode 13 by its lugs 15 from hooks 21 of carriage 2 (see FIGS. 6 and 8). When hooks 47–47′ and/or forks 48–48′ are detected in their working position by a known and not represented detection device, pivot 44 is uncoupled from coupling device 45, pivot 44′ is coupled with coupling device 45′ and the rod of cylinder 46′ is pushed out; yoke 41, that now bears a spent anode 13, rotates again 90° clockwise, which brings it in a horizontal position with, this time, hooks 47–47′ located between legs 40–40′ of fork 39. During and after this rotation anode 13 is supported in the yoke by hooks 47–47′ and by a leg of at least one of the forks 48–48′. When the loaded yoke 41 is detected in the horizontal position by a known and not represented detection device, rod 37 of cylinder 38 moves in and carriage 36 brings loaded yoke 41 in its lower releasing position, lugs 15 of anode 13 borne by yoke 41 being now located in guiding elements 70′ (see FIG. 9). When yoke 41 is detected in the lower releasing position by a known and not represented detection device, the rods of cylinders 52–52′ move in and the anode 13 falls on supporting elements 69–69′ of stacking means 29. These supporting elements 69–69′ are at that moment located some centimeters under the lower releasing position of yoke 41, the telescopic cylinder 67 being completely pushed out. While the rods of cylinders 52–52′ are moving in, i.e. while hooks 47–47′ and forks 48–48′ are going from their working position to their rest position, anode 13 keeps always substantially the same position thanks to the guiding elements 70′; these elements 70′ guide moreover anode 13 during its fall. Loaded carriage 2 that had stopped in stacking station 7 has started again unloaded after a time T to return to loading station 3.

When the next carriage 2 stops at stacking station 7, rod 37 of cylinder 38 is pushed out and carriage 2 returns with yoke 41 to its upper position. The rod of cylinder 46′ moves in and yoke 41 rotates 90° counter-clockwise, which brings it back to its vertical position. The rods of cylinders 52–52′ are pushed out and the anode is lifted from the carriage. Pivot 44′ is uncoupled from coupling device 45′, pivot 44 is coupled to coupling device 45, the rod of cylinder 46 moves in, and the loaded yoke rotates 90° counter-clockwise. Rod 37 of cylinder 38 moves in, yoke 41 gets back to its lower releasing position, shown in dotted lines on FIG. 6, lugs 15 of anode 13 borne by the yoke being located now in guiding elements 70. The rods of cylinders 52–52′ move in and anode 13 falls on the preceding anode. The afore-described cycle can start over again.

As the anodes pile up on supports 69–69′, the telescopic cylinder 67 moves in so that the upper anode remains some centimeters under the releasing position of yoke 41. When the pile of anodes has reached a predetermined height, the telescopic cylinder 67 moves completely in and the pile of anodes is thereby laid down on a pair 72 of support elements 73 of evacuation means 30. Chains 71 of evacuation means 30 move, thereby evacuating the pile of anodes, the telescopic cylinder 67 is pushed out and the formation of a pile of anodes on supports 69–69′ can start over again.

Very stable piles 9 are obtained as shown on FIG. 10.

It should be understood that the afore-described installation can be modified in many ways without leaving the scope of the present patent application.

So, for instance, the second stacking station 8 may be omitted, but this modification decreases of course the flexibility of the installation.

Monorail 1 and carriages 2 may be replaced by a conveying chain provided with hooks, but this modification would also reduce the flexibility of the installation.

Telescopic cylinder 67 may be replaced by a conventional cylinder, but this one would be much more encumbering than the telescopic cylinder.

Unloading station 6 may be located downstream of stacking stations 7 and 8, provided that the control system of the installation is modified ad hoc.

It is also possible to cause each carriage 2 to stop in each station 3, 22, 23, 5, 6, 7 and 8. This would enable to simplify the control system of the installation and would not give rise to a loss of productivity when enough carriages are available.

Instead of causing carriages 2 to stop during a predetermined time T in the stations where they have to be loaded or unloaded, they may also be stopped in these stations for the time needed for their loading or unloading, the end of this loading or unloading operation being then detected by a detecting device ad hoc.

Instead of causing rod 37 of cylinder 38 to move in when loaded yoke 41 is detected in the horizontal position, this rod may also be moved in as soon as the loaded yoke has rotated for instance 20° so as to combine the end of the rotation and the beginning of the lowering of the loaded yoke.

Instead of causing the rod of cylinder 46 to push out (or the rod of cylinder 46 to move in) when carriage 36 is detected in its higher position, it may also be done as soon as carriage 36 is detected in an intermediary position between its lower position and its upper position in order to combine the end of the rising and the beginning of the rotation of the unloaded yoke.

We claim:

1. A process for stacking spent anodes, which comprise a spent electrolytic plate and a pair of suspension lugs and which are vertically suspended by their lugs to hooks, said process comprising the steps of (a) lifting the anodes, one after the other, from the hooks by their lugs;

(b) rotating the lifted anodes alternately 90° and −90° around a horizontal axis, which, if the spent anodes were replaced by the new anodes they originate from, would substantially coincide with the horizontal median axis of the new anodes, this latter axis being located in the plane of the new anode and at equal distance from the top of its lugs and from the lower edge of its electrolytic plate;

(c) lowering the rotated anodes to a lower position;

(d) releasing the anodes in said lower position;

(e) providing under said lower position a support, on which the released anodes from a pile; and (f) lowering said support in such a way that the top of the anode pile being formed on it remains below said lower position.

2. A process according to claim 1 wherein the lugs of the anode, that is being released, are prevented from substantial horizontal movement.

3. A process according to claim 1 wherein the lugs of the anode, that is just released, are guided during the fall of the anode, that brings the anode from the said lower position to the said top of the anode pile.

4. A process according to claim 1 wherein, before lifting the spent anodes from the hooks, one examines whether they are suited to be handled by the means that one has for rotating the lifted anodes.

5. An apparatus for stacking spent anodes, which comprise a spent electrolytic plate and a pair of suspension lugs and which are vertically suspended by their lugs to hooks, said apparatus comprising (a) unhooking and rotating means adapted to lift the spent anodes from the hooks by their lugs, to rotate the lifted anodes alternately 90° and −90° around a horizontal axis, which, if the spent anodes were replaced by the new anodes they originate from, would coincide substantially with the horizontal median axis of the new anodes, this latter axis being located in the plane of the new anode and at equal distance from the top of its lugs and from the lower edge of its electrolytic plate, and to release the rotated anodes;

(b) first conveying means adapted to move said unhooking and rotating means vertically between an upper position for unhooking a suspended anode and a lower position for releasing a rotated anode;

(c) supporting means located under the said lower position; and (d) second conveying means adapted to move said supporting means vertically.

6. An apparatus according to claim 5 further comprising guiding elements adapted to prevent the lugs of the anode, that is in the lower releasing position, from making a substantial horizontal movement.

7. An apparatus according to claim 6 wherein the guiding elements extend downwards.

8. An apparatus according to claim 5 further comprising means to examine whether the spent anodes, which are suspended to the said hooks, are suited to be handled by the said unhooking and rotating means.

9. An apparatus according to claim 5 wherein the unhooking and rotating means comprise a yoke, a first pivot fastened to the yoke, first driving means to cause the first pivot to rotate first 90° clockwise and afterwards 90° in the opposite direction, or vice versa, first coupling means to couple the first pivot (44) with the first driving means (46) and to uncouple it therefrom, a second pivot (44') fastened to the yoke (41) and in line with the first pivot (44), second driving means to cause the second pivot to rotate first 90° clockwise and then 90° in the opposite direction, or vice versa, second coupling means to couple the second pivot with the second driving means and to uncouple it therefrom, a pair of mobile hooks mounted on the yoke, a pair of forks, and means mounted on the yoke to bring the hooks and forks from a rest position to a working position and vice versa.

* * * * *